US007882830B1

(12) United States Patent
Gabrel

(10) Patent No.: US 7,882,830 B1
(45) Date of Patent: Feb. 8, 2011

(54) COST EFFECTIVE PAINTBALL GUN SYSTEM

(75) Inventor: Stanley Gabrel, Round Lake, IL (US)

(73) Assignee: Tippmann Sports LLC, Fort Wayne, IN (US)

( * ) Notice: Subject to any disclaimer, the term of this patent is extended or adjusted under 35 U.S.C. 154(b) by 24 days.

(21) Appl. No.: 11/403,373

(22) Filed: Apr. 12, 2006

Related U.S. Application Data

(60) Provisional application No. 60/670,372, filed on Apr. 12, 2005.

(51) Int. Cl.
*F41B 11/00* (2006.01)

(52) U.S. Cl. ..... 124/73; 124/74; 124/75

(58) Field of Classification Search ..... 124/73–77, 124/80
See application file for complete search history.

(56) References Cited

U.S. PATENT DOCUMENTS

| | | | | |
|---|---|---|---|---|
| 5,280,778 | A | 1/1994 | Kotsiopoulos | |
| 5,613,483 | A * | 3/1997 | Lukas et al. | 124/73 |
| 5,769,066 | A * | 6/1998 | Schneider | 124/75 |
| 6,349,711 | B1 | 2/2002 | Perry et al. | |
| 6,349,717 | B1 | 2/2002 | Thompson et al. | |
| 6,474,326 | B1 | 11/2002 | Smith et al. | |
| 6,516,791 | B2 | 2/2003 | Perrone | |
| 6,644,295 | B2 | 11/2003 | Jones | |
| 6,889,681 | B1 | 5/2005 | Alexander et al. | |
| 6,925,997 | B2 | 8/2005 | Sheng | |
| 7,185,646 | B2 | 3/2007 | Jones | |
| 2004/0255923 | A1 | 12/2004 | Carnall et al. | |
| 2005/0005924 | A1 * | 1/2005 | Sheng | 124/74 |

* cited by examiner

*Primary Examiner*—Troy Chambers
(74) *Attorney, Agent, or Firm*—Barnes & Thornburg LLP

(57) ABSTRACT

A paintball gun system comprises a bolt defining a propellant passageway and a gun body defining the following elements: a receptacle for receiving the bolt, a firing charge storage chamber adjacent to but separate from the bolt receptacle, a gas inlet port, a first passageway between the storage chamber and the receptacle, a second fixed passageway between the gas inlet and the receptacle. The first passageway communicates with a first flow opening into the receptacle and the second passageway communicates with a second flow opening into the receptacle. The bolt is axially movable between a chargeup position and a firing position. In the chargeup position, the bolt and the body together define a confined flow circuit between the first opening and the storage chamber. In the firing position, the bolt and the body together define a confined flow circuit between the storage chamber and the discharge inlet.

9 Claims, 11 Drawing Sheets

COST EFFECTIVE PAINTBALL GUN SYSTEM

CROSS-REFERENCE TO RELATED APPLICATION

This application claims priority from U.S. Provisional Application for Patent No. 60/670,372 filed on 12 Apr. 2005.

FIELD OF INVENTION

This invention relates to pneumatic marking guns including paintball guns.

BACKGROUND OF THE INVENTION

The earliest paintball marking guns were used for marking in forestry and cattle ranching. Paintball marking guns are now more associated with a variety of targeting and simulated battle games (e.g. capture the flag). These guns launch a ball of paint with a frangible shell that is designed to hold the ball shape until striking an object after firing. Upon striking the object, the ball is set to break open leaving a paint spot.

Paintball guns typically employ a firing system powered by compressed gas such as air. Compressed gas is supplied from a supply tank which is mounted to or carried with the gun. The gun systems are equipped with pressure regulators which receive gas from the tank at a relatively high pressure and deliver gas at a reduced, more consistent pressure for propelling the paintball.

Prior art paintball guns usually consist of a bolt, a spring loaded hammer and a cocking handle. These conventional paintball guns have disadvantages since the hammer creates a kick back which causes the gun to go off target during rapid firing. Alternate types of paintball guns are more pneumatic in design. One pneumatic design is presented in U.S. Pat. No. 6,349,717 where a pneumatic piston is used to strike the valve instead of a hammer. The disadvantage of this type of design is that pneumatic piston still causes blow-back and an open pneumatic circuit directly to the gas source during firing operation. In addition, lubricant problems or temperature changes at the cylinder affect paintball velocity.

Other prior art pneumatic paintball guns include complicated firing mechanisms. Drawbacks of these more complicated types of guns include difficulty to operate and maintain, frequent breakdowns and high manufacturing cost. A common problem with all prior art of paintball guns is paintball breakage in the gun as the paintball drops from the paintball container (hopper) to the breach chamber and then is loaded to the barrel. In most cases, the paintball drops to the breach chamber by the force of gravity and during firing operation is being loaded to the barrel. In cases when rapid firing is perform, the paintball may be pushed to the barrel before the drop to the breach area is completed. Consequently, the paintball may be chopped. A paintball break in the gun not only causes a missed shot but also has a very negative effect on subsequent operations of the paintball gun because paint fouls the operating parts of the gun.

One other drawback of existing paintball gun designs is hopper mounting, normally on the top of the gun and positioned straight up or at a fixed angle with respect to the gun body. Paintball players usually position themselves behind the bunker to avoid being hit. According to the paintball game rules when a player's body or any part of his or her equipment including the hopper is hit, the player is out. In this situation a hopper sticking out of a bunker is not desirable. It would also be desirable to provide an improved paintball gun which has a hopper mounting angle adjustment.

In recent years electrically operated paintball guns have gained popularity due to a soft trigger pull where an electric switch is provided to activate paintball gun operations. Since paintball guns are portable devices, usage of low energy consumption electric actuators would be beneficial. Several electric paintball guns are equipped with a solenoid to actuate paintball gun operations. The drawback of using a solenoid is low energy output in the beginning of the stroke and low overall efficiency.

It therefore would be desirable to provide an improved pneumatic paintball gun with simple, efficient and robust firing mechanism with very few moving parts. It would be further beneficial for paintball players to have a gun design which has adjustable bolt speed to prevent paintball breakage.

Paintball capsules from different manufactures have different rigidities. A paintball gun which has an adjustable gas storage chamber capacity to adjust the ratio of firing pressure to gas volume in accordance with the type of paintball would be beneficial.

Finally it is a further object of the invention to provide a novel paintball gun that employs a low energy electro pneumatic flow valve and low energy use of linear actuators to provide more gun shots from single electric battery.

Paintball guns are available with either manual or power-assisted trigger mechanisms to control the release of compressed gas.

BRIEF SUMMARY OF THE INVENTION

The present invention pertains to a field of pneumatic lunching devices, more specifically pneumatic markers called paintball gun. In particular, the present invention relates to a gun system including a special firing mechanism, an adjustable bolt speed, an adjustable angle of the hopper holder and an adjustable volume gas storage chamber. Another aspect of this invention is to provide different options for a low energy consumption electropneumatic flow valve and electric actuators for electrically operated paintball guns.

A preferred paintball gun system according to the present invention comprises a bolt defining a propellant passageway and a gun body defining the following elements: a receptacle for receiving the bolt, a firing charge storage chamber adjacent to but separate from the bolt receptacle, a gas inlet port, a first passageway between the storage chamber and the receptacle, a second fixed passageway between the gas inlet and the receptacle. The first passageway communicates with a first flow opening into the receptacle and the second passageway communicates with a second flow opening into the receptacle. The bolt is axially movable between a chargeup position and a firing position. In the chargeup position, the bolt and the body together define a confined flow circuit between the first opening and the storage chamber. In the firing position, the bolt and the body together define a confined flow circuit between the storage chamber and the discharge inlet.

A paintball gun according to the present invention overcomes the problems of the prior compressed gas paintball guns by providing a fully pneumatic gun design with simplified firing mechanism and eliminating other deficiencies related to the prior art paintball guns. Firing mechanism is being activated by simple two way flow valve with short stroke which enables the player to do rapid firing. A gas storage chamber provides efficiency to the paintball gun by storing exact amount of compressed gas to fire a paintball, and it is located in the lower portion of the gun body. The main components of the firing mechanism include gun body, hollow bolt, a gas storage chamber and several passageways configured to communicate with each other. The trigger and the two way valve activates the firing mechanism. When bolt is in retracted position gas from gas source enters and fills gas storage chamber and also enters the two way valve. When the trigger is pulled, the gas from the two way valve is directed to the piston located on the bolt and causes the bolt to move forward. While the bolt is moving forward, first access from compress gas source to gas storage chamber is closed and than when paintball is loaded into the barrel gas storage chamber is being opened to fire the paintball. When trigger is released, a gas in front of the bolt piston is being vented to the atmosphere through the two way valve and the spring located in rear portion of the bolt retracts the bolt to ready to fire position, first closing communication between gas storage chamber and an opening to fire the paintball and than permit communication between gas storage chamber and compress gas source.

One of the objects of this invention is to provide variable bolt velocity achieved by adjustment of the spring tension which retracts the bolt and will result in different bolt speeds while retracting and subsequently when moving forward. This process enables fine tuning of the bolt loading velocity and therefore the prevention of the paintball breakage.

The two way valve spool can be pneumatically biased or spring biased to reset itself to it's original position and subsequently retracting the trigger to ready to fire position. The present invention provides gas storage chamber which can be fixed or adjustable in capacity/volume. The gas storage volume adjustment is done by moving the wall of the chamber to the inside or the outside of the gas storage chamber. Another object of this invention is adjustable hopper holder with a radial slot for continuous or incremental adjustment with several bores placed on the bolt circle. Another option of adjustment is provided by utilizing (a plunger) ball-spring preloaded mechanism which results in quick angular hopper adjustment during the paintball game.

According to another aspect of the invention, there is provided low energy use piezo valve, voice coil actuator and piezo actuator with lever mechanism to obtain high energy efficiency electrically operated paintball gun.

BRIEF DESCRIPTION OF THE DRAWINGS

In the accompanying drawings that form part of the specification like numerals are employed to designate like parts throughout the same.

DETAILED DESCRIPTION OF THE INVENTION

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figures 1, 2:
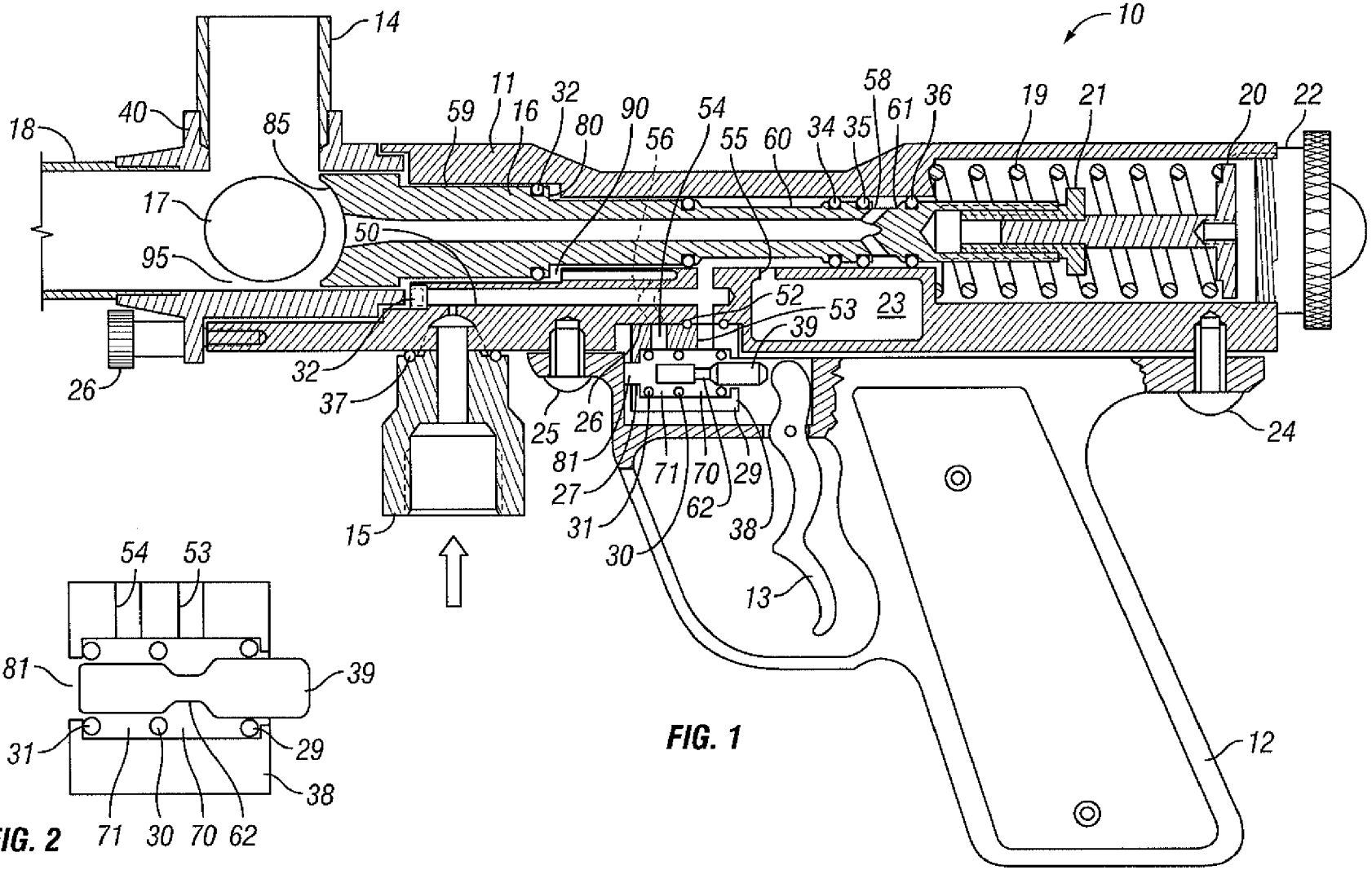
FIG. 1 illustrates a paintball gun in a side elevation where gun mechanism is in a cross-section to show gun details in accordance with present invention.
FIG. 2 is a cross section of a flow valve and it shows valve spool in the stage where the trigger is being pulled in the middle of a cycle.
Figure 3:
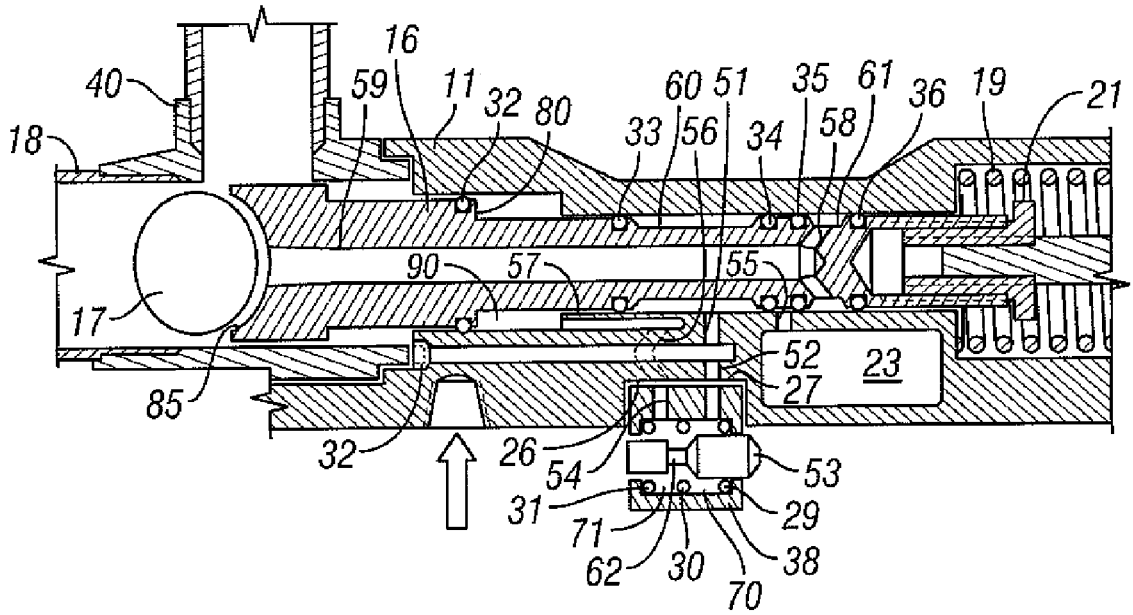
FIG. 3 is a cross section of the paintball gun mechanism and shows the paintball gun in the condition where the trigger is pulled completely and compressed gas communicates with the bolt piston through the flow valve and causing the bolt to move into forward position.
Figure 4:
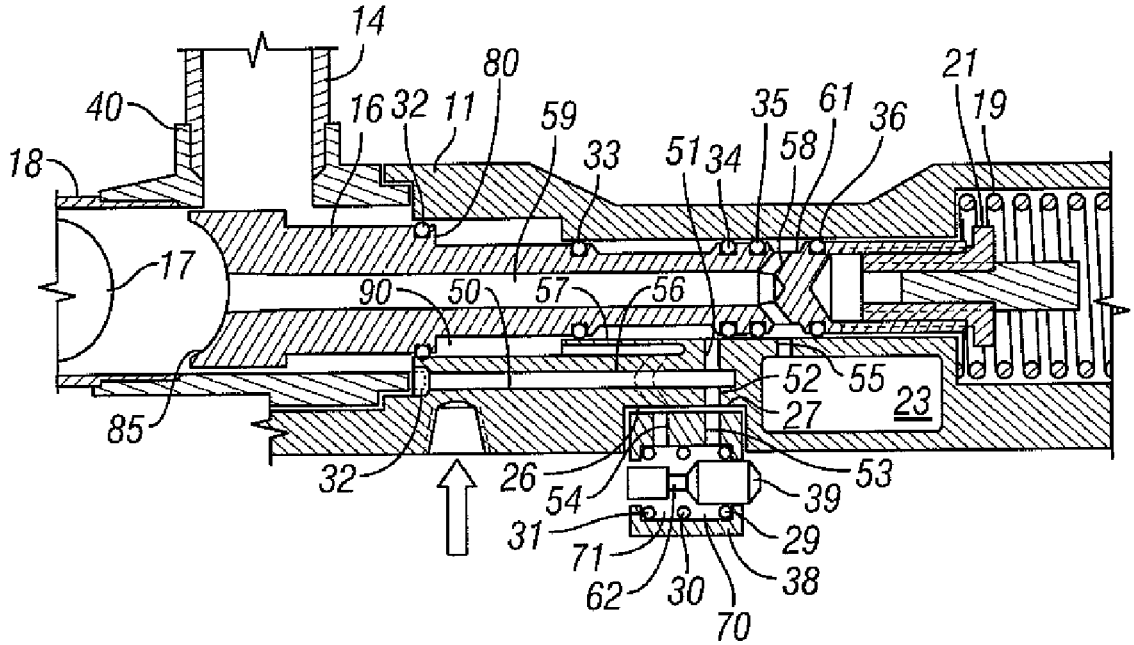
FIG. 4 is another cross section of the paintball gun mechanism and shows completed cycle when the trigger is pulled and bolt has moved to firing position.

Referring to FIGS. 1 through 3, paintball gun comprises a bolt 16 having a proximal end and a distal end and defining a firing passageway 59 from a discharge inlet 58 in the proximal end to a discharge outlet 85 in the distal end. The body 11 defines a receptacle for receiving the bolt, a firing charge storage chamber 23 adjacent to but separate from the bolt receptacle, a gas inlet port 15, a first passageway between the storage chamber and the receptacle 50 such that the storage chamber 23 communicates with a first opening 55 in the receptacle, a second passageway between the gas inlet 15 and the receptacle such that the gas inlet 15 communicates with a second opening in the receptacle 51. The bolt 16 is axially movable within the receptacle between a chargeup position (FIG. 1) in which the bolt 16 and the body 11 together define a passageway between the first opening 55 and the second opening 51 and a firing position (FIG. 4) in which the bolt 16 and the body 11 together define a passageway between the first opening 55 and the opening 58 in the proximal end. The receptacle has an open end and a closed end, the bolt is biased towards the closed end with a spring mechanism 19, 20 and the spring mechanism includes a compression level adjustment 20.

Generally the present invention relates to a compressed gas paintball gun 10 which incorporates several components shown in FIGS. 1-24. As is common with other guns, in FIG. 1 the gun 10 includes body 11. handle 12 and pivotally mounted trigger 13. Gun body is being mounted with handle by screws 24 and 25. A barrel 18 is attached to a hopper holder 40 which is being mounted to a gun body 11 with screw 26. The hollow bolt 16 is slidably movable inside the gun body 11 and it's shown in retracted position according to FIG. 1. The bolt is being biased to retracted position by spring 19 through adjustable screw 20. Threaded bushing 21 serves as a stop when bolt 16 moves forward. Safety cap 22 prevents from engagement of the moving parts with the gun user.

The gas from the gas source is being provided through adapter 15 and then enters bore 50. Plug 32 prevents gas from escaping into the atmosphere. Chamber 23 is being filled with compressed gas through communication of bores 50, 51, circumferential recess 60 and bore 55. At the same time cylinder 70 is being charged with compressed gas through the bore 52 located in the gun body 11 and bore 53 placed in flow valve body 38. Cylinder 70 is being sealed by o-rings 33 and 34. When the trigger is pulled a sequence of events starts in the flow valve. First by moving spool 39 FIG. 2 slightly forward and than sealing cylinder 71 with o-rings 31 and 30 and then opening communication between cylinder 70 and 71 through circumferential recess 62. When the trigger 13 is pulled completely a cylinder 71 communicates with the bolt piston 80 through bores 54, 56 and 57. When gas pressure is being applied on the bolt piston 80 a sequence of events will start in the firing mechanism, first closing communication between gas source flowing through bore 51 with o-rings 33 and 34. Compressed gas storage chamber is being sealed from gas source by o-rings 34 and 35. When bolt is fully advanced forward shown in FIG. 4 gas communications is permitted between gas storage chamber and discharge opening 85 through bore 55, circumferential recess 61 and bore 59 to fire a paintball 17. By releasing a trigger a pneumatic biased valve spool 39 will move itself to it's original position isolating communication between cylinder 70 and 71 (FIG. 1) with o-rings 29 and 30 and then provides communication between cylinder 90 and opening 27 through bores 57, 56, 54 and venting compressed gas from cylinder 90 to the atmosphere. Spring 19 will retract bolt to ready to fire position. Tension adjustment of spring 19 with screw 20 will result with different bolt speeds.

Figure 5:
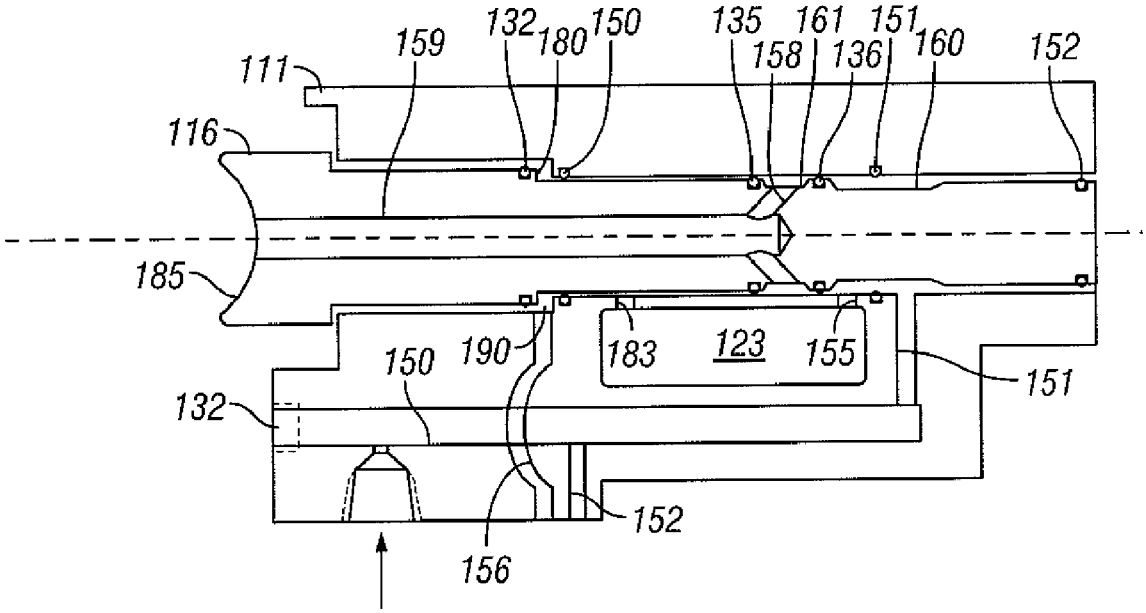
FIG. 5 is an alternate embodiment of firing mechanism and shows partial cross section of the mechanism in the position when the trigger is released.
Figure 6:
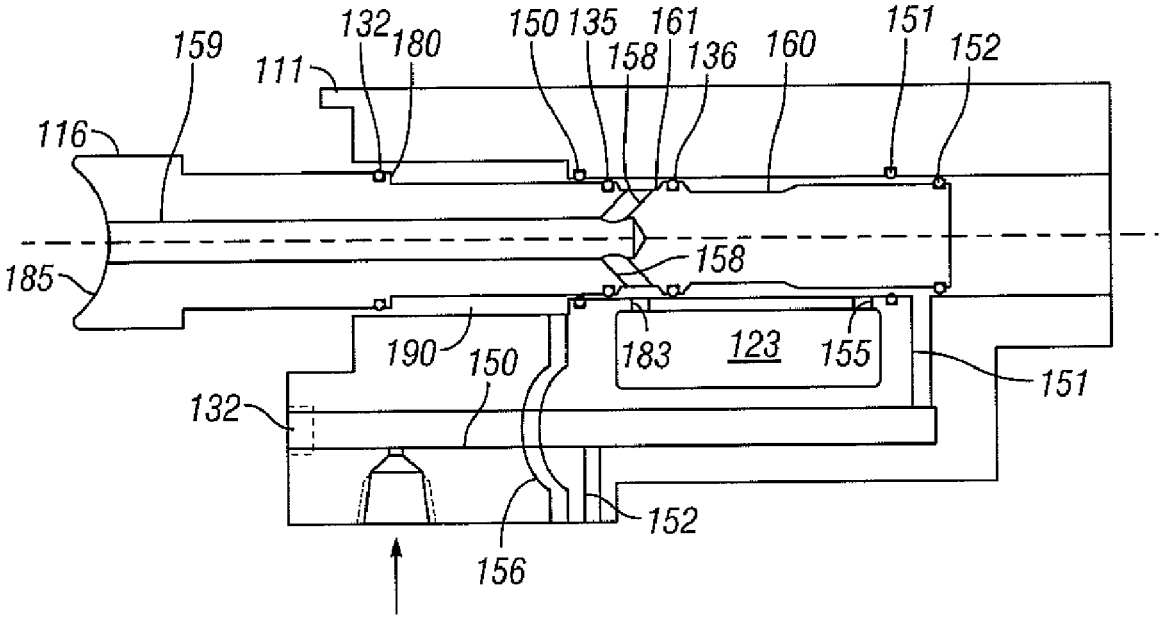
FIG. 6 is an alternate embodiment of firing mechanism and shows partial cross section of the mechanism in the position when the trigger is pulled.

FIG. 5 and FIG. 6 relate to an alternative embodiment of the firing mechanism. FIG. 5 shows firing mechanism in retracted position where compressed gas is being supplied to the gas storage chamber through passageway 150, 151, circumferential recess 160 and another passageway 155. o-rings 136 and 152 isolate circumferential recess 160. FIG. 6 shows firing mechanism in firing position when access of compressed gas source to gas storage chamber is closed by o-rings 151 and 152 and communication of gas is provided between gas storage chamber and discharge opening 180 thru passageway 185, circumferential recess 161 and passageways 158, 159.

Figure 8:
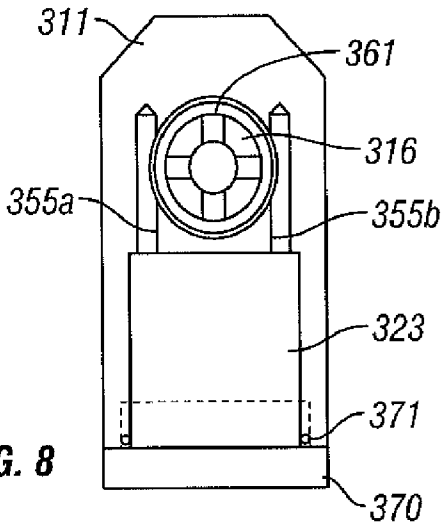
FIG. 8 is a cross section of the preferred embodiment and it illustrates a method of gas delivery to radial bores located on the bolt to both sides of the bolt at the same time.
Figure 7:
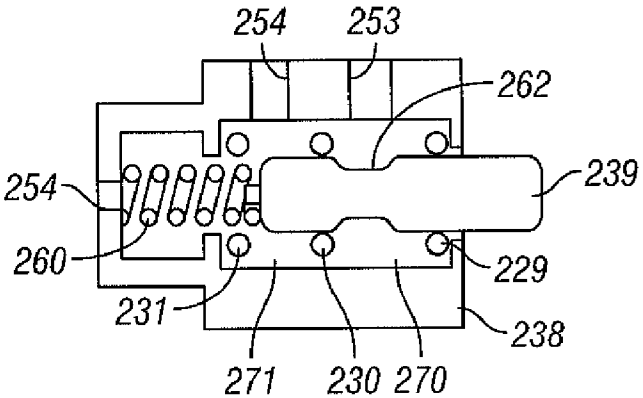
FIG. 7 is a second embodiment of the flow valve where spring is being used to bias spool valve to it's original position.

FIG. 7 shows alternate embodiment of a spring biased flow valve where spring 260 retracts valve spool 239 to it's original position. FIG. 8 represents preferred embodiment for communication between gas storage chamber 323 and circumferential recess 361 by providing two passageways 355*a*. 355*b* a 180 deg. a part to supply gas to both sides of the bolt.

Figure 10:
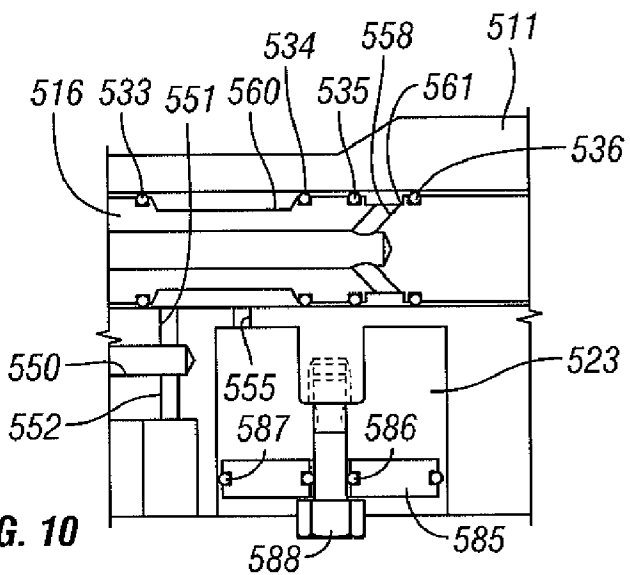
FIG. 10 is a partial cross section of the firing mechanism with an alternate embodiment of the gas storage chamber and it shows rectangular shape adjustable volume gas storage chamber.
Figure 9:
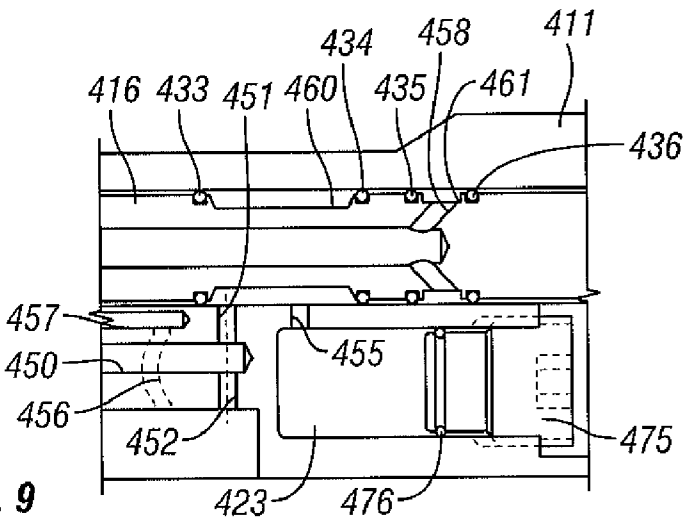
FIG. 9 is a partial cross section of the firing mechanism with an alternate embodiment of gas storage chamber and it shows cylindrical shape adjustable volume gas storage chamber.

FIG. 9 and FIG. 10 refer to preferred embodiment of adjustable volume gas storage chamber. In FIG. 9 gas storage chamber is cylindrical in shape where adjusting plug 475 with sealing o-ring 476 can be screwed in or out of the chamber and subsequently changing volume of the chamber. A rectangular shape compressed gas storage chamber 523 shown in FIG. 10 has a screw 588 and sealing o-ring 586, 567 and rectangular shape plate 585. By adjusting the screw 588 in or out, the volume of the gas chamber 523 will change accordingly.

Figure 11:
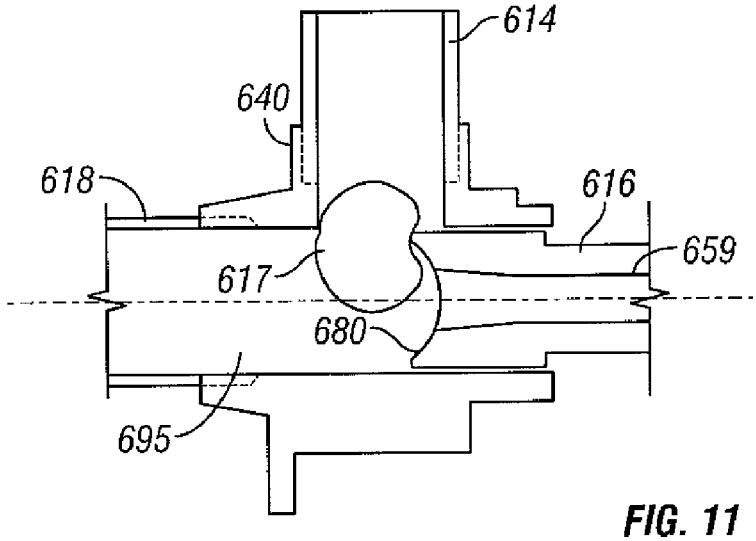
FIG. 11 is a partial cross section of the firing mechanism showing bolt striking paintball before it drops to ready to fire position.
Figure 12:
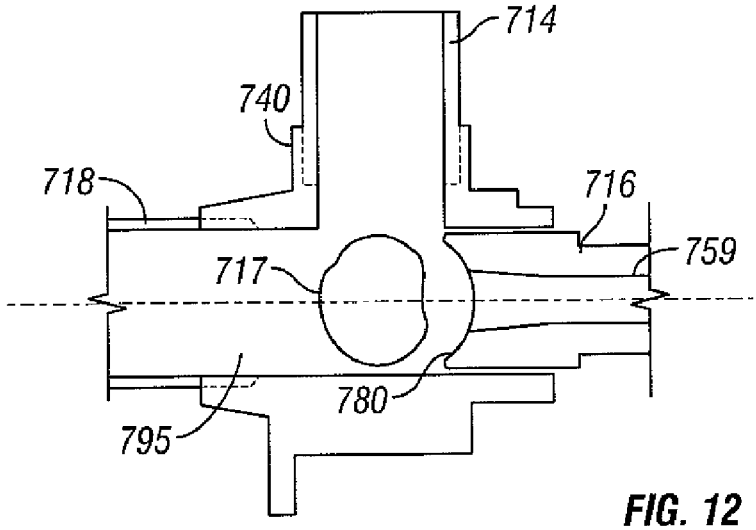
FIG. 12 is a partial cross section of the firing mechanism showing bolt withdrawn from firing position when trigger is released and paintball is in ready to fire position.
Figure 13:
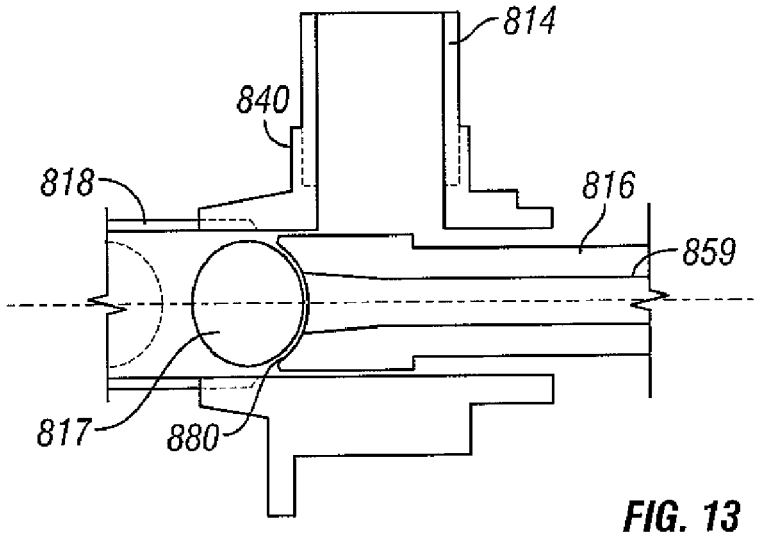
FIG. 13 is a partial cross section of the firing mechanism and illustrates the bolt in firing position firing the paintball which was earlier stroke by the bolt.
Figure 14:
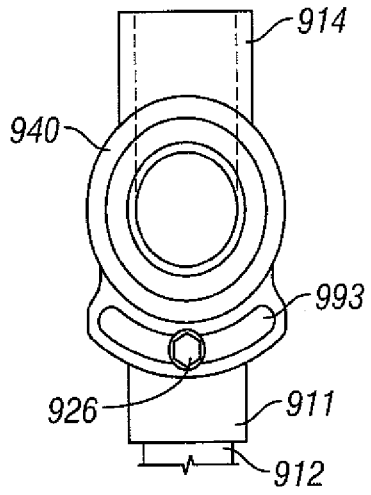
FIG. 14 is a front elevation view of the paintball gun and shows continuous angle adjustment mechanism of the hopper holder.

Scenario presented in FIG. 11, FIG. and FIG. 13 is a situation when bolt speed is adjusted to a certain value using spring 19 (FIG. 1) so that paintball 617 FIG. 11 will not be chopped when hit by the bolt before it drops to breach chamber 695. After trigger 13 (FIG. 1) is released bolt 716 (FIG. 12) will move to retracted position and paintball 717 will be ready to fire. FIG. 13 shows paintball 817 in firing position.

Figure 15:
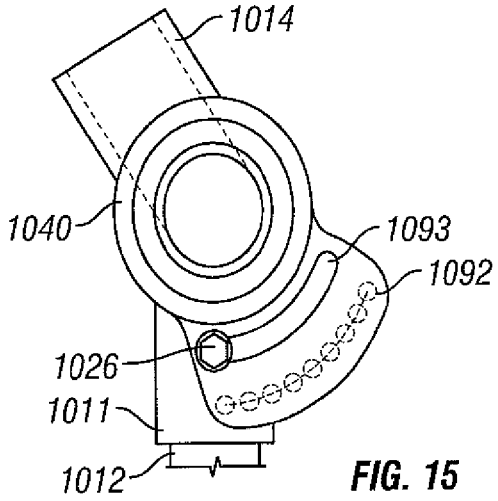
FIG. 15 is a front elevation view of the paintball gun and shows incremental angle adjustment mechanism with preloaded spring ball device.
Figure 16:
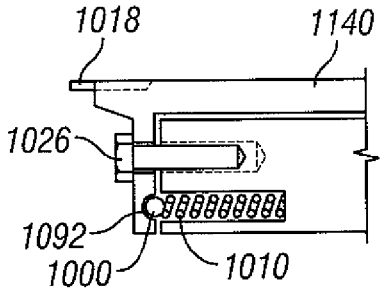
FIG. 16 is a cross section of the preloaded spring ball device shown in FIG. 15.
Figure 17:
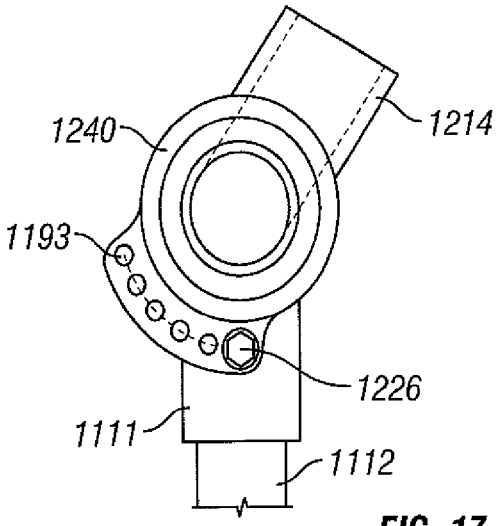
FIG. 17 is a front elevation view of the paintball gun and shows incremental angle adjustment mechanism of the hopper holder.

Turning now to FIGS. 14-17 details are shown of preferred embodiment for adjustment of the hopper holder 940. Referring to details in FIG. 14 the angle of the hopper holder 940 can be adjusted continuously by utilizing circular slot 993. Screw 926 secures hopper holder 940 in it's place after adjustment. FIG. 15 and FIG. 16 has details of alternative embodiment of hopper holder adjustment using preloaded spring 1010 and the ball 1000 to incrementally change angular position of the hopper holder according to the ball indentations 1092. The screw 1026 is not set tight to enable for the hopper holder 1040 to change position. Hopper holder 1240 showed in FIG. 17 has several holes placed on the bolt circle for another incremental method of adjustment.

Figure 18:
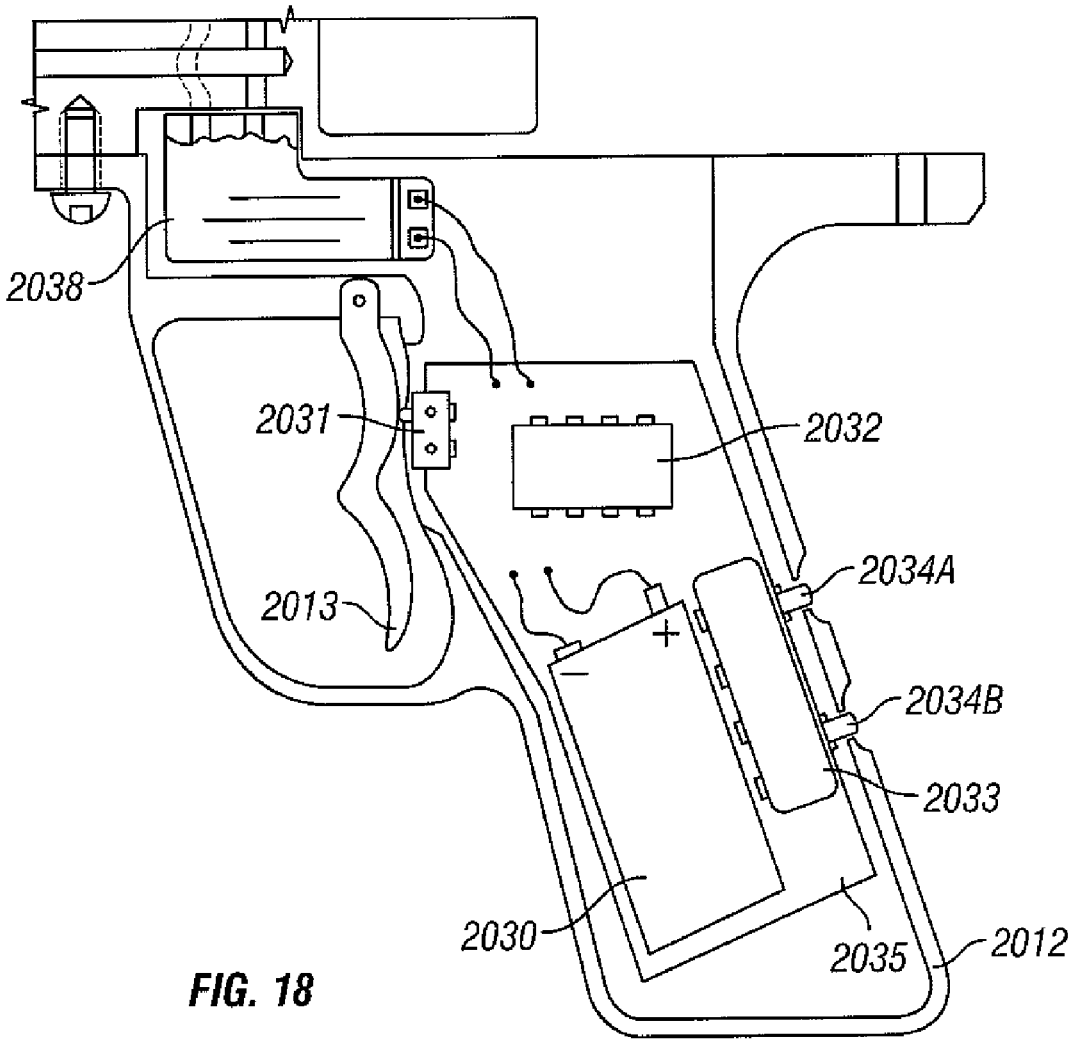
FIG. 18 is a partial cross section of the electric actuated paintball gun with piezo valve.

Next, viewing FIG. 18 it is seen electronic circuit board 2035, which can be mounted in the grip 2012 and includes a microprocessor 2032, source of electric power 2030 and alphanumeric display unit to display and monitor various data. A plurality of input buttons 2034*a* and 2034*b* are provided for setting different functions and modes. Trigger sensor 2031 is being activated by the trigger 2013. Piezovalve 2038 is connected to the circuit board 2035 and is configured to activate firing operations of the paintball gun. Circuit board 2035 is configured to process a sequence of electrical pulses to operate piezovalve 2038.

Figure 19:
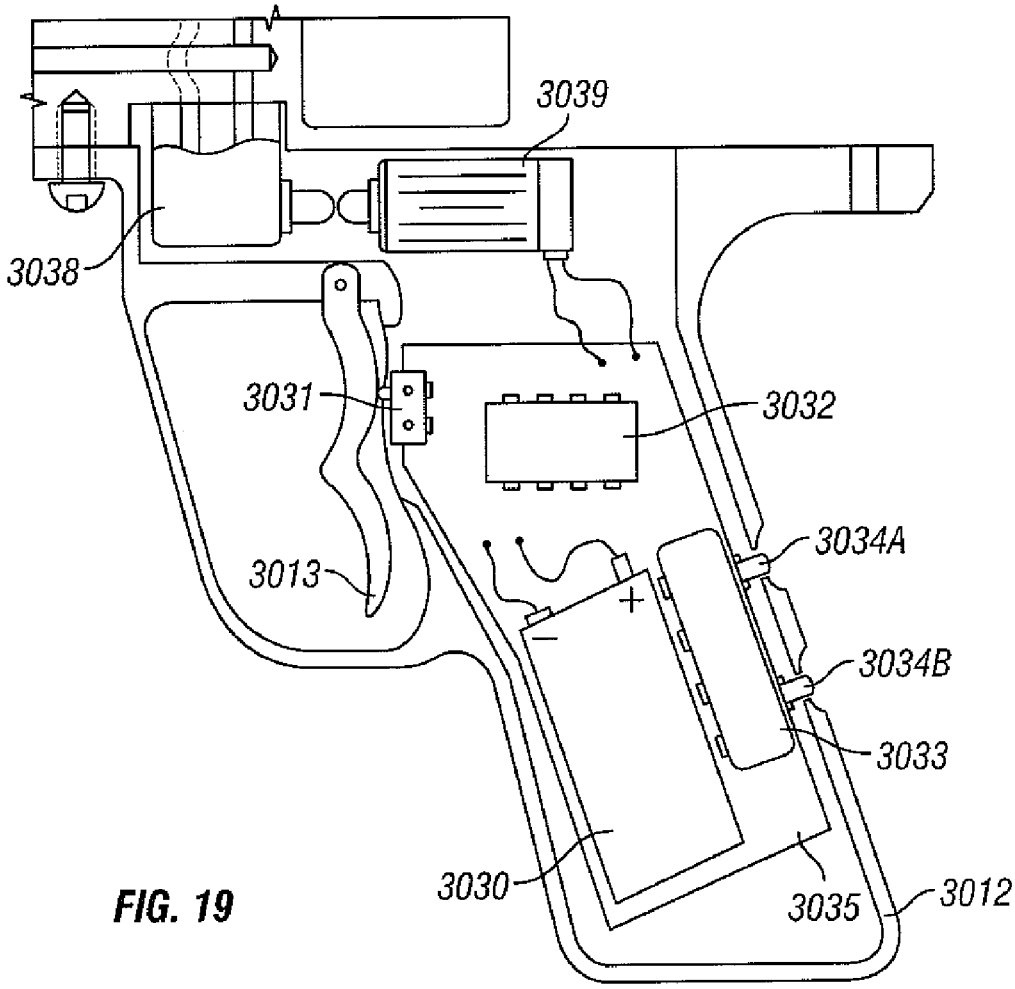
FIG. 19 is a partial cross section of the electric actuated paintball gun with voice coil actuated.
Figure 20:
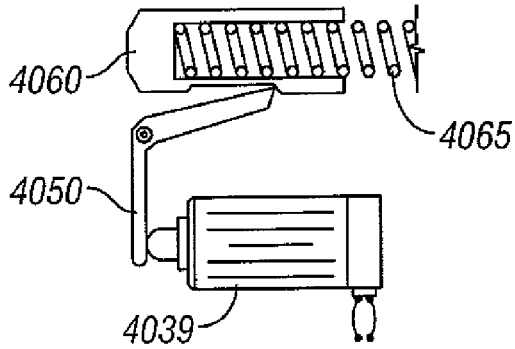
FIG. 20 is a partial view and partial cross section of electrically actuated sear with spring preloaded hammer mechanism where voice coil actuator is being used as an actuator.

Referring now to FIG. 19, a preferred embodiment of electrically operated paintball gun is shown, where voice coil actuator 3039 is utilized to actuate a'flow valve 3038. A trigger 3013 actuate trigger sensor 3031, and than electric signal is being processed by a microprocessor 3032 to power voice coil actuator 3039. Electronic circuit board 3035, generally housed in protective enclosure may be mounted within the gun grip 3012. Said electronic circuit board 3035 contains power source 3030 and input buttons 3034*a* and 3034*b*. A display 3033 may be used for visual representation of monitoring and setting various parameters of the paintball gun.

Figure 21:
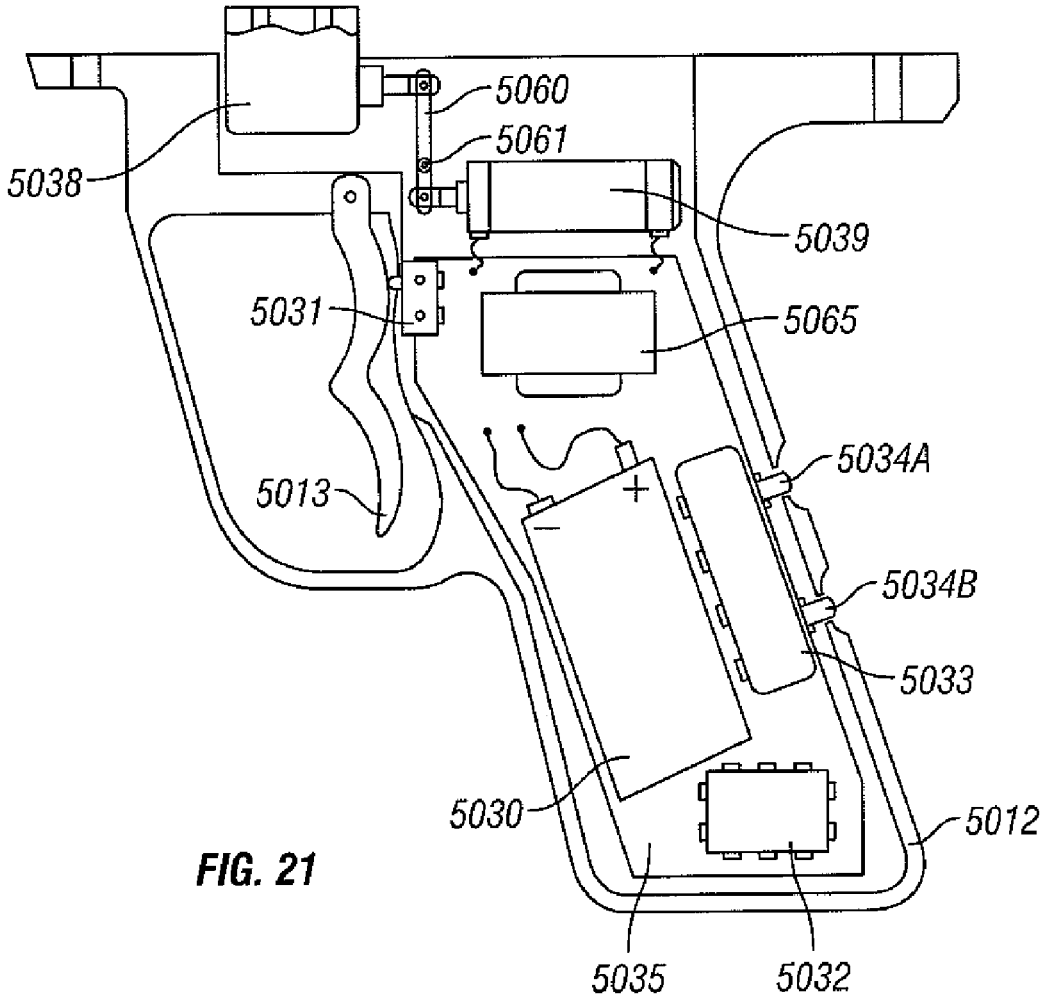
FIG. 21 is a partial cross section of electrically actuated paintball gun with piezo actuator and a lever.
Figure 22:
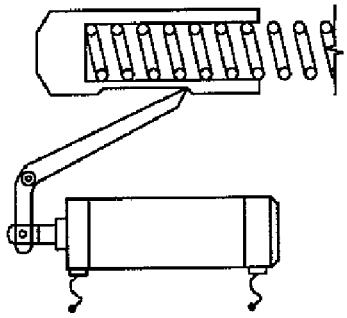
FIG. 22 is a partial view and partial cross section of electrically actuated sear with spring preloaded hammer where piezo actuator is being used as an actuator.

Considering FIG. 21 an alternate embodiment of the electrically operated paintball gun is presented which comprises a piezo actuator 5039 to activate flow valve 5038 through lever 5060 which rotates around the pivot 5061. Similarly as shown in FIG. 18 and FIG. 19 circuit board 5035 is provided with power source 5030, microprocessor 5032, display 5033, trigger sensor 5031 and input buttons 5034*a* and 5034*b*. Amplifier 5065 generates high voltage electricity to power piezo actuator 5039.

Figure 23:
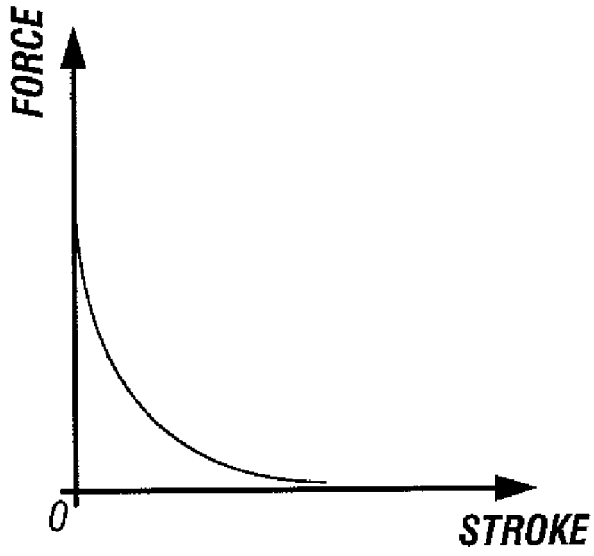
FIG. 23 is a graphical illustration of the solenoid stroke to force characteristics used in prior art paintball guns.
Figure 24:
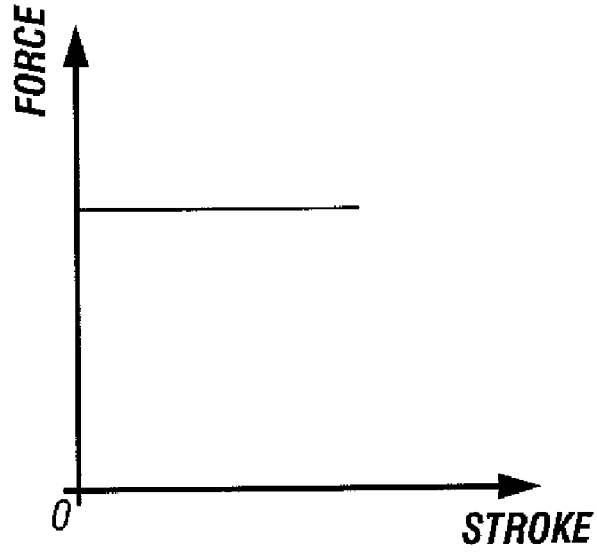
FIG. 24 is a graphical illustration of the voice coil actuator characteristics used in present invention.

The purpose of the FIG. 23 and FIG. 24 is to compare amount of force being generated from solenoid and voice coil actuator in relation to a stroke. FIG. 23 represents characteristics of a solenoid used in prior art and FIG. 24 relates to the present invention where voice coil actuator is used.

Figure 25:
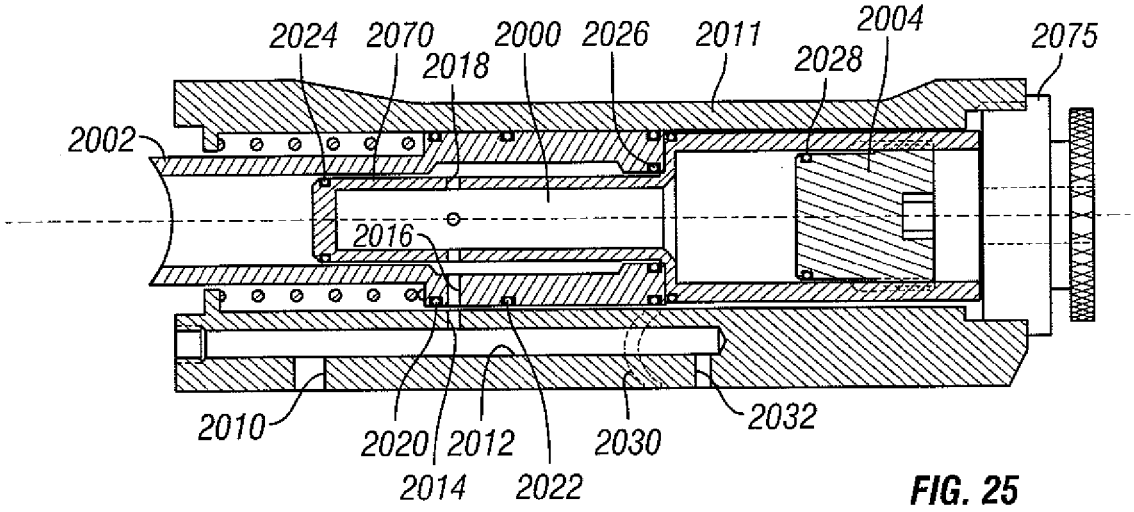
FIG. 25 is an alternate embodiment of a firing mechanism and it shows cross-sectional view of the mechanism in retracted position.
Figure 27:
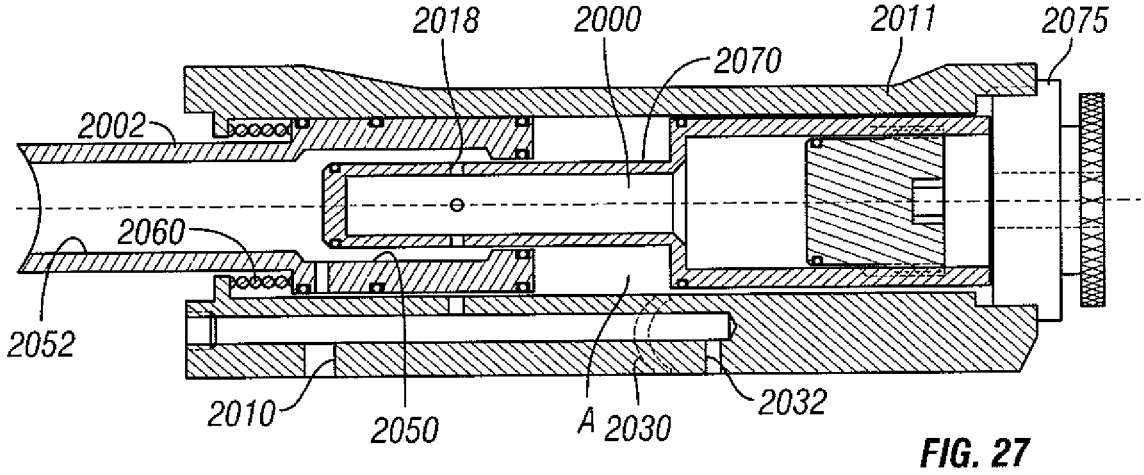
FIG. 27 is a cross-sectional view of the firing mechanism in firing position of the regulator.

FIG. 25 illustrates another preferred embodiment of the firing mechanism where compressed gas chamber 2000 is partially located within the bolt 2002. Gas storage chamber capacity can be changed by adjusting screw 2004. Bolt 2002 and bolt slide 2070 is cylindrical in shape and are placed inside the gun body 2011. Bolt 2002 is movable between retracted position shown in FIG. 25 and firing position as shown in FIG. 27. Cap 2075 secures bolt slide inside the gun body 2011.

Figure 26:
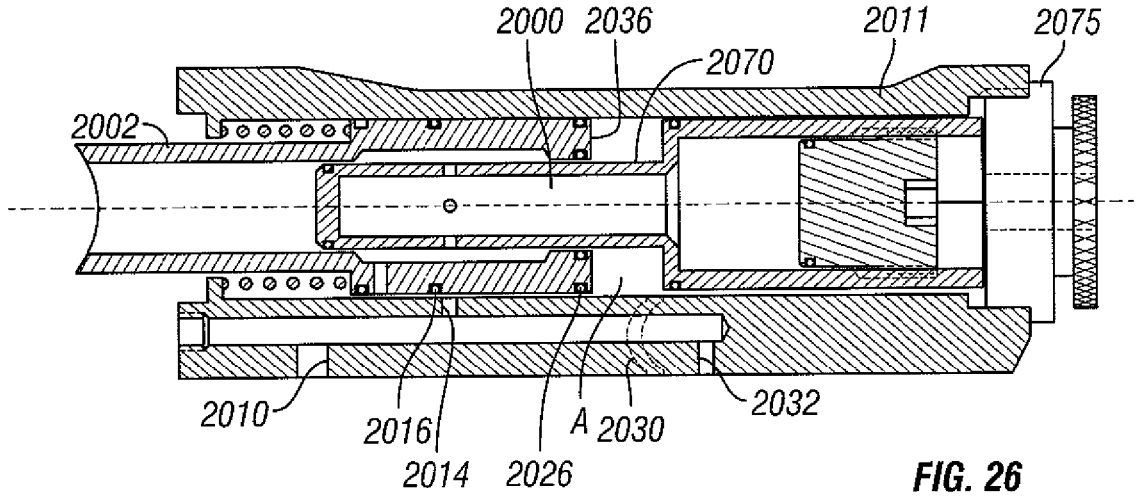
FIG. 26 is a cross-sectional view of the firing mechanism shown in the middle of firing cycle.

When the trigger (not shown) is released compressed gas enters gas storage chamber 2000 through the inlet bore 2010 and passageways 2012, 2014, 2016 and 2018. Passageways 2016 and 2018 are sealed by o-rings 2020, 2022 and 2024, 2026 respectfully. Gas storage chamber 2000 is sealed by o-rings 2024, 2026 and 2028. Passageway 2030 and 2032 are connected to the flow valve (not shown). Referring now to FIG. 26 the same embodiment is presented as in FIG. 25, except the boil 2002 is in the middle of the firing cycle. First after trigger is pulled the passageways 2032 and 2030 are connected through the flow valve (not shown), and gas enters area "A" and force is being generated on the surface 2036 driving the bolt 2002 forward. Then during this process, first, access to the gas storage chamber 2000 is closed by o-ring 2016 and 2026 and then as shown in FIG. 27 circumferential recess 2050 placed on internal bore 2052 of the bolt 2002 allows for gas flow from gas storage 2000 to be open through the internal bore of the bolt 2018 to fire a paintball. After trigger is released, first, gas flow from passageway 2032 will be blocked inside the flow valve and than gas from area "A" will vent to the atmosphere. The spring 2060 will bias the bolt 2002 to ready to fire position.

Informal claims:

A compress gas powered paintball gun operable to shot paintballs, said gun comprising:

a gun body a compressed gas storage chamber a bolt for loading paintball to a launching chamber, wherein said bolt is configured to permit compressed gas flow to fill gas storage chamber while sealing the gas storage chamber from venting to internal bore of the bolt in ready to fire position and release compress gas from gas storage chamber to internal bore of the bolt while sealing gas storage chamber from said gas source in firing position.

a valve adapted for moving the bolt to firing position; and a spring for biasing the bolt to ready to fire position.

A firing mechanism comprising:

a gun body;

a compressed gas storage chamber;

a bolt for loading paintball to a launching chamber, whereas said bolt is configured to permit compressed gas flow to fill gas storage chamber while sealing the gas storage chamber from venting to the internal bore of the bolt in ready to fire position and release compressed gas from gas storage chamber to internal bore of the bolt while sealing gas storage chamber from said gas source in firing position.

A mechanism for operating firing valve assembly comprising:

a body;

a valve adapted for moving the bolt to firing position by applying compressed gas on the bolt piston; and a spring for biasing the bolt to ready to fire position;

An electrically operable pneumatic paintball gun comprising:

a gun body;

a firing valve mechanism configured to selectively supply compressed gas to a launching chamber;

a piezovalve configured to operate firing mechanism;

an electric circuit for controlling said piezovalve;

a trigger-operable electric switch to initiate launching sequence of the paintball gun; and a battery;

An electrically operable pneumatic paintball gun comprising:

a gun body;

a firing mechanism configured to selectively supply compressed gas to a launching chamber a flow valve configured to operate firing mechanism;

a linear actuator coupled to said flow valve;

an electric circuit for controlling said linear actuator;

a trigger operable electric switch to initiate launching sequence of the paintball gun; and a battery.

where linear actuator is a voice coil actuator where linear actuator is a piezo actuator A compressed gas powered paintball gun comprising:

a gun body;

a firing mechanism configured to selectively supply compress gas to a lunching chamber;

a flow valve configured to operate firing mechanism;

a spring tension adjustment mechanism for adjusting bolt speed.

N1. An electronically operable pneumatic paintball gun comprising:

a gun body;

a firing valve mechanism configured to selectively supply compressed gas to a launching chamber;

a piezo valve configured to operate firing mechanism;

an electric circuit for controlling said piezo valve;

a switch to initiate launching sequence of the paintball gun; and a source of electric power.

N2. An electrically operable pneumatic paintball gun comprising:

a gun body;

a flow valve configured to selectively supply compressed gas to a lunching chamber;

a linear actuator cooperating with the said flow valve directly or indirectly;

an electric circuit for controlling said linear actuator;

a switch to initiate launching sequence of the paintball gun; and a source of electric power.

N3. An electrically operable pneumatic paintball gun according to claim N2 wherein the linear actuator is a voice coil actuator.

N4. An electrically operable pneumatic paintball gun according to claim N2 wherein the linear actuator is a piezo actuator.

Numerous variations and modifications of the embodiments described above can be effected without departing from the spirit and scope of the novel features of the invention. It is to be understood that no limitation with respect to the specific apparatus illustrated herein is intended or should be inferred. It is, of course, intended to cover by the appended claims, all such modifications as fall within the scope of the claims.

What is claimed is:

1. A paintball gun system comprising:

a bolt having a proximal end and a distal end and defining a firing passageway from a discharge inlet in the proximal end to a discharge outlet in the distal end;

a body defining a receptacle for receiving the bolt, a firing charge storage chamber adjacent to but separate from the bolt receptacle, a gas inlet port, a first passageway between the storage chamber and the receptacle such that the storage chamber communicates with a first fluid opening into the receptacle, a second passageway between the gas inlet and the receptacle such that the gas inlet communicates with a second flow opening into the receptacle;

wherein the bolt is axially movable within the receptacle between a chargeup position in which the bolt and the body together define a confined flow circuit between the first fluid opening and the storage chamber, and a firing position in which the bolt and the body together define a confined flow circuit between the storage chamber and the discharge inlet.

2. The paintball gun according to claim 1 wherein the storage chamber has an adjustable volume.

3. The paintball gun according to claim 1 wherein the storage chamber has an adjustable volume provided by a movable wall partially defining the storage chamber.

4. The paintball gun according to claim 1 wherein the receptacle has an open end and a closed end, the bolt is biased towards the closed end with a spring mechanism and the spring mechanism includes a compression level adjustment.

5. The paintball gun according to claim 1 wherein the receptacle has an open end and a closed end portion and the bolt is biased towards the closed end portion with a spring housed in the closed end portion.

6. The paintball gun according to claim 5 wherein the closed end portion has a threaded cap linked to the spring for adjusting the compression level of a spring.

7. The paintball gun according to claim 1 wherein the gun body defines a third passageway between the storage chamber and the receptacle terminating in a third flow opening into the receptacle.

8. The paintball gun according to claim 1 wherein the confined flow circuit defined in the chargeup position includes the first flow opening.

9. The paintball gun according to claim 1 the gun body defines a third passageway between the storage chamber and the receptacle terminating in a third flow opening into the receptacle, and the confined flow circuit of the discharge position includes the third passageway.

* * * * *